US006666798B2

(12) United States Patent
Borsheim

(10) Patent No.: US 6,666,798 B2
(45) Date of Patent: Dec. 23, 2003

(54) THERAPEUTIC AND REHABILITATION APPARATUS

(76) Inventor: John T. Borsheim, 407 Tillery St., Austin, TX (US) 78702

( * ) Notice: Subject to any disclaimer, the term of this patent is extended or adjusted under 35 U.S.C. 154(b) by 340 days.

(21) Appl. No.: 09/682,104

(22) Filed: Jul. 20, 2001

(65) Prior Publication Data

US 2002/0010056 A1 Jan. 24, 2002

Related U.S. Application Data

(60) Provisional application No. 60/220,695, filed on Jul. 21, 2000.

(51) Int. Cl.[7] ..... A63B 22/00; A63B 21/02

(52) U.S. Cl. ..... 482/54; 482/906; 434/247

(58) Field of Search ..... 482/66–69, 54, 482/51, 148, 121–123, 91, 906; 601/23, 27, 34, 35; 434/247, 253, 250, 255

(56) References Cited

U.S. PATENT DOCUMENTS

| | | | | | |
|---|---|---|---|---|---|
| 4,505,681 | A | * | 3/1985 | Jones | 434/253 |
| 4,825,731 | A | * | 5/1989 | Stojanowski | 81/111 |
| 5,167,601 | A | * | 12/1992 | Frappier | 482/121 |
| 5,378,156 | A | * | 1/1995 | Rohe | 434/253 |
| 5,803,881 | A | * | 9/1998 | Miller | 482/124 |
| 6,264,584 | B1 | * | 7/2001 | Bass | 482/54 |

* cited by examiner

*Primary Examiner*—Stephen R. Crow
(74) *Attorney, Agent, or Firm*—Howrey Simon Arnold & White LLP

(57) ABSTRACT

An apparatus adapted for coupling between an attendant positioned either behind or in front of a patient on an exercise assembly such as a treadmill for rehabilitation of a functionally impaired leg of the patient such as one suffering from paralysis. The apparatus comprises a leg appliance secured to a patpatient'sg, with a leg bracket adjacent to the knee. A leg brace secured to an attendant's leg also includes a bracket adjacent to the attattendant'see. At least one connecting member provides coupling from the leg bracket to the bracket of the leg brace to transmit motion from an attendant's leg to a patient's leg using forces acting from the leg brace to the leg appliance through the connecting member. An ankle appliance having an upper extension and a lower extension proximate the ankle is attached to a patient's foot and an ankle brace is similarly attached to an attendant's foot. The ankle brace has a brace upper extension and a brace lower extension adjacent the ankle of an attendant with the brace upper extension coupled by an upper ankle link to the upper extension of the patient's ankle appliance, while the brace lower extension is coupled by a lower ankle link to the lower extension of the ankle appliance. Each of the upper link and the lower link are adapted to create movement of a patient's foot corresponding to movement of a foot of an attendant during walking. Further coupled to the ankle brace is an offset link for transferring side-to-side motions. The coordinated leg and ankle movement allows a patient's paralysis damaged leg to duplicate the walking motion of an attendant's leg.

18 Claims, 4 Drawing Sheets

THERAPEUTIC AND REHABILITATION APPARATUS

CROSS REFERENCE TO RELATED APPLICATIONS

This application claims the benefit of U.S. Provisional Application No. 60/220,695 filed Jul. 21, 2000.

BACKGROUND OF INVENTION

1. Technical Field

The present invention generally relates to equipment used during rehabilitation of spinal and otherwise injured patients. More specifically, the present invention relates to an apparatus for assisting a patient to perform walking motion by connection of the apparatus between the legs of an injured patient and the legs of an attendant.

2. Background Information

Rehabilitation for victims of leg paralysis resulting from spinal cord injury requires using equipment that gives a paralyzed patient the opportunity to revitalize dormant muscles during relatively normal physical activity. Physical therapy for these patients has begun employing exercise assemblies such as treadmills that are normally associated with health and fitness clubs and the like.

In one application, a patient wears a body harness that supports the pelvic area and the upper torso while using a specially adapted treadmill. A strap extending from each shoulder to above the head of the patient attaches to an overhead support bar that is part of a support frame. A cable and pulley arrangement is activated to draw the shoulder straps up towards the support bar. This apparatus exerts an upwardly directed force on the patient in magnitude up to and including the point at which all weight has been counteracted and therefore removed from the patient's legs. Positional adjustment of the support frame allows the patient's feet to rest on the flat surface of the treadmill.

Once the treadmill begins to move the patient's feet contacting the flat surface are drawn along by the movement. In order to perform a walking motion, the patient traditionally has required assistance from one or more attendants. When performing such a therapeutic procedure, each attendant occupied a position by the side of the treadmill from which they could reach, lift and move the patient's legs in a motion that mimicked the walking process. A paraplegic required two attendants occupying positions on both sides of the treadmill in order to lift and move the patient's legs through the correct actions for walking. Alternatively, each attendant placed a foot of the patient in a forward position ahead of the patient's body. Normal, linear movement of the treadmill then displaced the foot to a position behind the patient. Completion of each attendant-assisted movement represented one stride for the patient. When a striding foot reached its rearmost position, the attendant on that side of the patient again lifted the foot from the flat surface of the treadmill and pulled it forward back to the starting position readied to allow the treadmill to effect another stride. The process of assisted walking of the suspended patient would continue giving the patient the opportunity to attempt to "learn" the waking process over again, while simultaneously strengthening their legs from the effort they are able to contribute during the therapy session.

The use of this technique for rehabilitation by reintroducing spinal injury sufferers to the familiar motion and pleasure of walking has been encouraging in terms of its results. For example, a hemiplegic, i.e., one who retains control over one leg, may perform a walking motion with assistance from only one attendant. The attendant repositions the injured leg while the patient still controls and moves his or her functioning leg. As indicated above, a paraplegic requires two attendants, i.e., one for each leg. Further, a quadriplegic requires even additional attendants for steadying the suspended body while the walking therapy is in progress.

A scarcity of skilled attendants limits the number of patients who may benefit from this type of rehabilitating treatment. This has led to attempts to develop mechanical devices that may assist with the walking process in the absence of an attendant.

One such device is a jointed leg brace that includes computer controlled actuators for moving sections of the brace in a way that simulates the gait of a walker. The brace is a complicated structure that must be strapped to a patient's hip, as well as outside the patient's leg in three locations—at the thigh, just above the calf and at the ankle. One or two braces may be used, depending upon the patient's condition. As before, the patient wears a harness for suspension by a frame with his or her feet resting on the flat surface of a treadmill. As the treadmill moves, the computer controlled brace performs strides by appropriately lifting and placing the patient's legs relative to the moving treadmill.

This use of computer controlled equipment presents at least two potential disadvantages. Firstly, there is the associated cost, which includes an expensive, computer assisted mechanical structure and its associated maintenance. Such a mechanical structure may be at least as expensive as the use of multiple rehabilitation attendants. Secondly, there is the possibility of computer or equipment malfunction that, in extreme cases, could lead to further injury of an unattended patient.

In view of the above described deficiencies associated with the use of known designs for assisted walking rehabilitation equipment and procedures, the present invention has been developed in order to alleviate these drawbacks and provide further benefits to the user. These enhancements and benefits are described in greater detail herein below with respect to several alternative embodiments of the present invention.

SUMMARY OF INVENTION

The present invention in its several disclosed embodiments alleviates the drawbacks described above with respect to conventionally designed rehabilitation equipment. It incorporates several additionally beneficial features that simplify therapy procedures and lower costs by reducing attendant-to-patient ratio.

Rehabilitation procedures according to the present invention require the use of equipment and apparatus to assist a patient paralyzed by spinal or other trauma, such as strokes or other illnesses, to perform a walking motion. An attendant supervises and works with the patient in exercise activities related to walking. Equipment used during supervised exercise includes a body harness worn by the patient and a treadmill. The body harness attaches to an overhead support that bears an adjustable portion of the weight of the patient while allowing contact between the patient's feet and the movable belt of the treadmill. A supervising attendant takes a position on the treadmill either in front of or behind the patient.

Before exercise begins, connection is made between the healthy legs of the attendant and the injured legs of the patient using rehabilitation apparatus according to the present invention. The rehabilitation apparatus includes a leg appliance and ankle appliance worn by the attendant and patient, with separate linkage between the leg appliances and the ankle appliances. A single piece of apparatus comprises two leg appliances adapted for interconnection between the attendant and patient, as well as two ankle appliances also adapted for interconnection between the patient and attendant. One or two pieces of rehabilitation apparatus may be used depending on the need for treatment to one or both of the patient's legs. For example, an injured left leg would require connection of the left leg of the patient to the left leg of the attendant. A paraplegic patient would require both legs to be connected to the legs of the attendant.

After positioning and connecting the rehabilitation apparatus between the patient and attendant, the treadmill may be energized causing the belt to move. As the belt slowly moves, the attendant begins to walk. The rehabilitation apparatus transmits the walking motions of the attendant through the connected leg appliances and linked ankle appliances to the patient's legs, depending on which are connected. Each step taken by the attendant at a position walking behind or in front of the patient causes stepping motion to be induced in and performed by the patient under the motivation and control of the rehabilitation apparatus. While an attendant's healthy legs lift and reposition a patient's injured legs, the attendant positioned behind the patient may also reach forward to the patient above the waist to assist with stability and weight transfer as the patient attempts to re-develop their ability to walk. The positioning of the attendant and use of the rehabilitation apparatus provide a much improved approach to increasing the confidence and desire of a patient to regain their ability to walk unaided.

More particularly, the present invention provides an apparatus adapted for coupling between an able-bodied attendant positioned behind a patient for rehabilitation of a leg damaged by paralysis. The apparatus comprises a leg appliance secured to a patient's shin, with a leg bracket adjacent to the patient's knee. A leg appliance or brace secured to an attendant's shin also includes a bracket adjacent to the knee. At least one connecting rod provides coupling from the leg bracket to the bracket of the leg brace to transmit motion from an attendant's leg to a patient's leg using forces acting from the leg brace to the leg appliance through the connecting rod.

An ankle appliance having an upper extension and a lower extension proximate the ankle is attached to a patient's foot and an ankle brace is similarly attached to an attendant's foot. The ankle brace has a brace upper extension and a brace lower extension adjacent the ankle of the attendant with the brace upper extension coupled by an upper ankle link to the upper extension of the patient's ankle appliance, while the brace lower extension is coupled by a lower ankle link to the lower extension of the ankle appliance. An offset link is connected to the attendant's or patient's ankle brace. This link extends rearwardly, where it slidably engages with a stationary support. This arrangement assists the attendant in transferring side-to-side foot motions to the patient without undue twisting or stressing to the ankle and leg of the attendant. Each of the upper link and the lower link are adapted to create movement of a patient's foot corresponding to movement of a foot of an attendant during walking whereby coordinated leg and ankle movement allows a patient's paralysis damaged leg to duplicate the walking motion of an able-bodied attendant's leg. It should be appreciated that the apparatus not only provides for the proper leg extension and foot placement for the walking action, but also utilizes appropriate parallel connections and link for communicating the tilting and side-to-side motions, respectively, of the foot as it moves through a step.

The beneficial effects described above apply generally to the exemplary devices and mechanisms disclosed herein of the rehabilitation apparatus for spinally injured patients. The specific structures through which these benefits are delivered will be described in detail herein below.

BRIEF DESCRIPTION OF DRAWINGS

The invention will now be described in greater detail in the following way of example only and with reference to the attached drawings, in which.

DETAILED DESCRIPTION

As required, detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but instead merely as a basis for the claims and as a representative basis for teaching one skilled in the art ways to variously employ the present invention.

Figure 1:
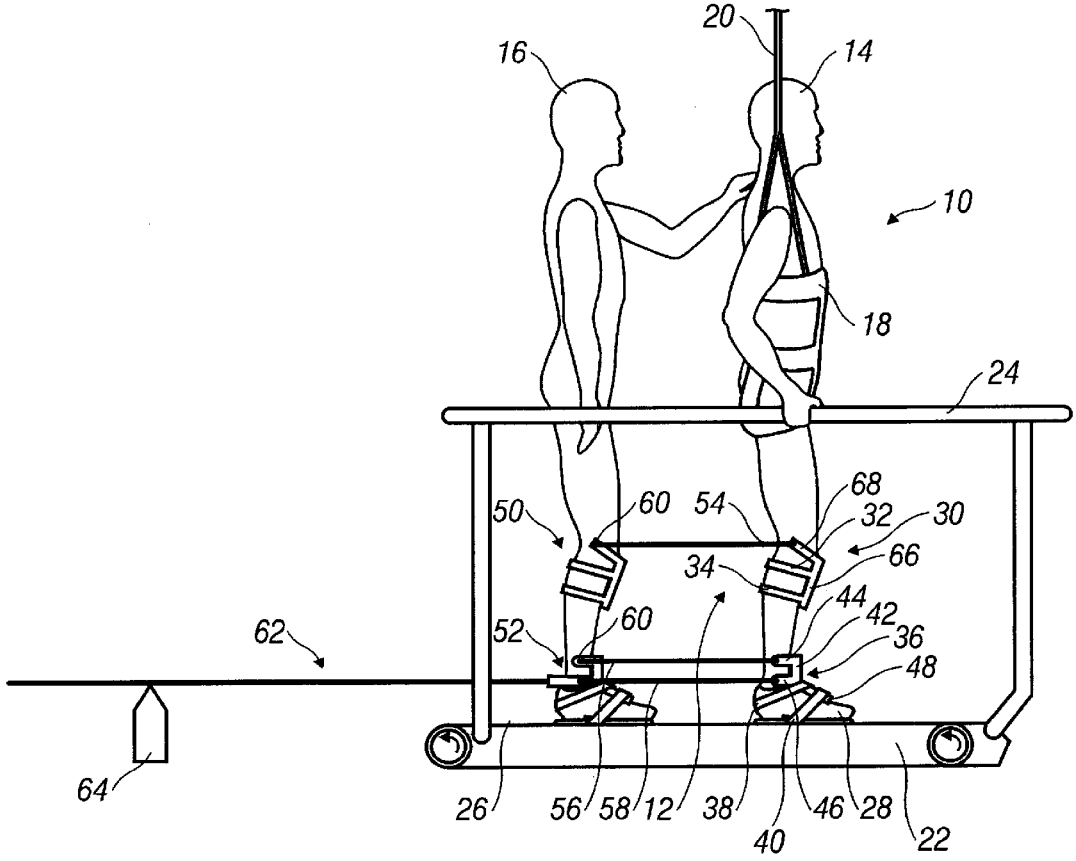
FIG. 1 is a side elevation showing an apparatus according to the present invention adapted to coordinate the walking motion of a suspended patient with that of an attendant.

Referring to the figures wherein like numbers represent like parts throughout the several views, FIG. 1 provides a side elevation of lifting equipment 10 used with an apparatus 12 constructed according to the teachings of the present invention for assisting a patient 14 to develop the ability to walk after sustaining a spinal or other debilitating injury or illness causing paralysis in one or both legs. While illustrating the preferred embodiment of the patient 14 in front of the attendant 16, it should be understood that the invention is not limited to placing the patient 14 in front, and may also be used with the attendant 16 in front.

In preparation for the exercise of walking, the attendant 16 assists in placing a supporting harness 18 around the patient's hips and upper torso. The supporting harness 18 includes a suspension strap 20 for attachment to a support bar (not shown). The support bar is part of a support structure placed in close proximity to an exercise assembly 22. The motion of the exercise assembly 22 aids the patient 14 in performing a walking motion.

After placing the patient 14 between the handrails 24 of the treadmill 22 and connecting the suspension strap 20 to the support bar, adjustment of the support structure positions the supporting harness 18 until the patient 14 adopts a suspended position that allows contact between the surface of the movable belt 26 of the treadmill 22 and the soles of the patient's shoes 28. The suspended position allows leg movement for the patient 14 without the hindrance of up to full body weight.

With the patient 14 positioned and supported between the handrails 24 of the exercise assembly 22, the attendant 16 attaches a leg appliance 30 to either or both shins of the patient's legs injured or paralyzed by spinal injury. An upper strap 32 attaches the leg appliance 30 to the shin just below the patient's knee. A lower strap 34, positioned approximately at mid-calf, completes securement of the leg appliance 30 to a patient's shin.

The rehabilitation apparatus 12 according to the present invention also includes an ankle appliance 36 attached to the patient's shoe 28, or directly about the foot by an ankle strap 38 and instep strap 40. The ankle appliance 36 includes a bracket 42 having an upper extension 44, a lower extension 46 and a foot stem 48 coupled therewith.

Having positioned the patient 14 and attached the leg appliance 30 and the ankle appliance 36, the attendant 16 secures a leg brace 50 and an ankle brace 52 to match the number of appliances 30, 36 used by the patient 14. Standing on the treadmill, the attendant 16 then makes connection from the attendant's leg brace 50 to the patient's leg appliance 30 by means of a connecting rod 54. Similar connections are made between the attendant 16 and the patient 14 at the ankles, using an upper ankle link 56 and a lower ankle link 58. The connecting rod 54 and upper and lower ankle links 56, 58 may be adjustable in length, and terminate in joints 60 adapted for rotation between the connector 54 and links 56, 58, the leg appliance 30 and leg brace 50, and the ankle appliance 36 and ankle brace 52. The joints 60 may take any form that allows rotation between parts. Suitable structures include ball and socket joints, as well as other known types of rotatable bearings or linkages that may include such members as axle pins. Additional synchronization between the legs of the attendant 16 and patient 14 results when connectors 54 and links 56, 58 provide attachment between the outside and the inside of the patient's and attendant's legs. An offset link 62 may be attached to the attendant's ankle brace 52 and extend behind the attendant 16 over an offset link support 64 for assisting the attendant 16 in transferring side-to-side foot motions to the patient without imparting twisting or stress to the attendant's ankle and knee joints. As stated above, the attendant 16 can be either in front or behind the patient 14. The offset link 62 can be attached to either the front or rear ankle brace 42, 52. This offset link 62 further extends either in front of or behind the connected patient 14 and attendant 16. In the preferred embodiment, the attendant 16 is behind the patient 14, with the offset link 62 attached to the rear brace 52 trailing behind over the offset link support 64.

Upon completion of assembly of the various parts of the rehabilitation apparatus 12, the treadmill 22 may be operated to cause linear movement of the belt 26. The onset of movement requires the attendant 16 to walk at the speed set by the moveable belt 26. Leg movement of the attendant 16 causes coordinated movement of the affected legs of the patient 14 using forces transmitted through the rehabilitation apparatus 12. With each stride, the heel of the attendant's foot makes initial contact with the surface of the moving belt 26 before the sole of the foot fully engages its surface for rearward movement. When this movement places the leg in a suitably extended position behind the attendant 16, the heel raises and the attendant's toes become the only point of contact with the belt 26. From this position, the attendant 16 lifts the affected foot and leg prior to executing forward extension of the leg to begin a new stride. Changes of the attendant's leg and ankle positions cause movement of the leg brace 50 and ankle brace 52 producing corresponding changes in the positions of the leg appliance 30 and ankle appliance 36 of the patient 14. Each stride of the attendant 16 facilitates therapeutic movement of the injured leg(s) of the patient 14 who, being supported by the suspension strap 20, expends minimal energy to execute a similar walking motion.

Figure 2:
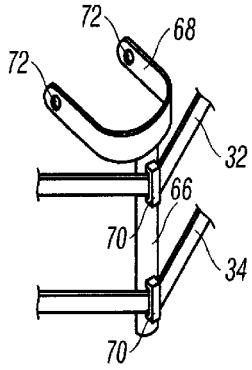
FIG. 2 is a perspective view of a leg appliance for attachment to the shin of either a patient or an attendant.

Having briefly described how an attendant 16 may assist in patient rehabilitation using an apparatus 12 according to the present invention, the various parts of the apparatus 12 will be described in greater detail with reference to FIGS. 2, 3*a* and 3*b*. FIG. 2 shows a patient leg appliance 30 of similar construction to the leg brace 50 used by an attendant 16. The leg appliance 30 includes a shin stem 66 and a substantially U-shaped leg bracket 68. The shin stem 66 attaches just below a wearer's knee, being held there by tightening an upper strap 32 just below the knee, and a lower strap 34 approximately in the region of a person's calf. The straps 32, 34 may be held in position relative to the shin stem 66 using eyelets 70 as shown in FIG. 2. Retention devices other than eyelets may be used as will be recognized by those having ordinary skill in the art. Such alternative retention devices include methods of permanent or temporary fastening of the straps 32, 34 to the stem 66, including mechanical fasteners such as hook and loop fasteners or other forms of interference fasteners, riveted strap attachment, and sewn attachment of binding elements.

The correct position of a leg appliance 30 after tightening the upper 32 and lower 34 straps places the opposing limbs of the substantially U-shaped bracket 68 on either side of a wearer's knee. The opposing limbs of the bracket 68 include terminal openings 72 as points for pivotal joining of connecting rods 54 on either side of the knee. Preferably, the end of a connecting rod 54 includes a complementary opening for alignment with an opening 72 of the bracket and attachment thereto using an axle pin or other suitable connecting device that allows pivotal movement between a connecting rod 54 and a bracket 68. Reference to FIG. 1 and FIG. 2 shows how a patient's leg appliance 30 and an attendant's leg brace 50 may be positioned and connected to coordinate leg movement between the patient 14 and attendant 16.

Figure 3A:
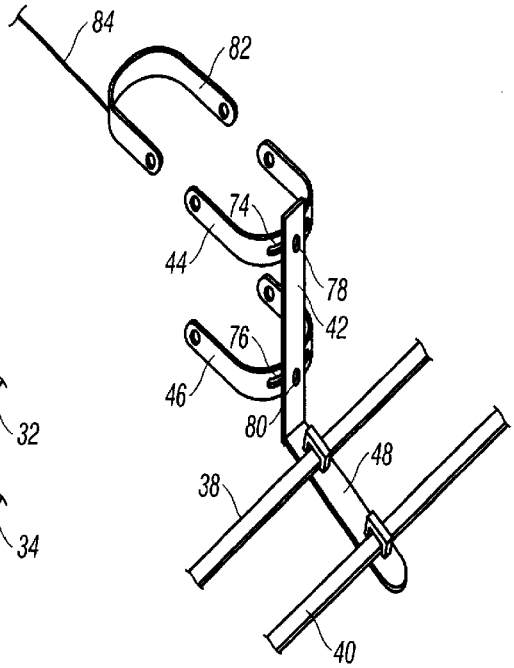
FIG. 3*a* shows a perspective view of a right ankle appliance and offset link used in unifying movement between the feet of a patient and an attendant.
Figure 3B:
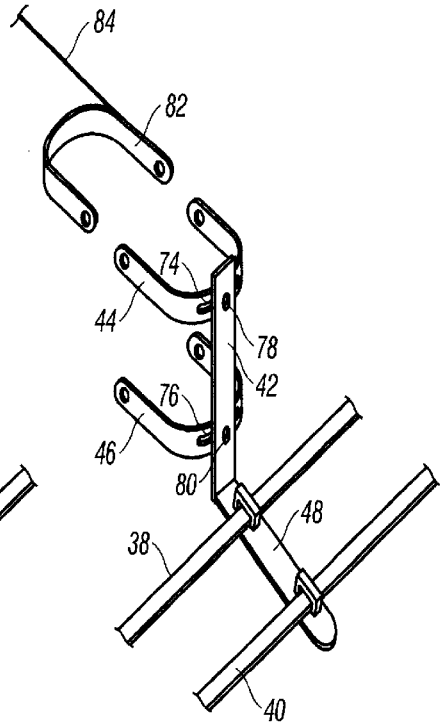
FIG. 3*b* shows a perspective view of a left ankle appliance and offset link used in unifying movement between the feet of a patient and an attendant.
Figure 4:
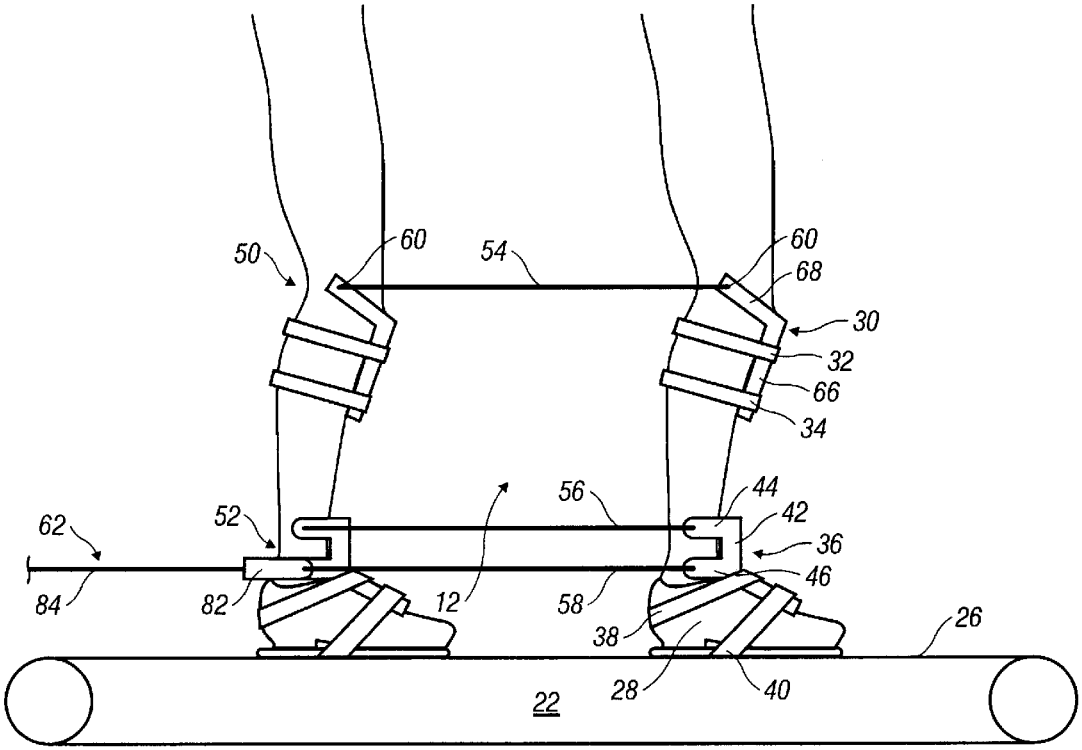
FIG. 4 provides a side elevation showing interconnection between leg appliances and ankle appliances according to the present invention with the feet of a patient and an attendant placed flat against the surface of a treadmill belt.
Figure 5:
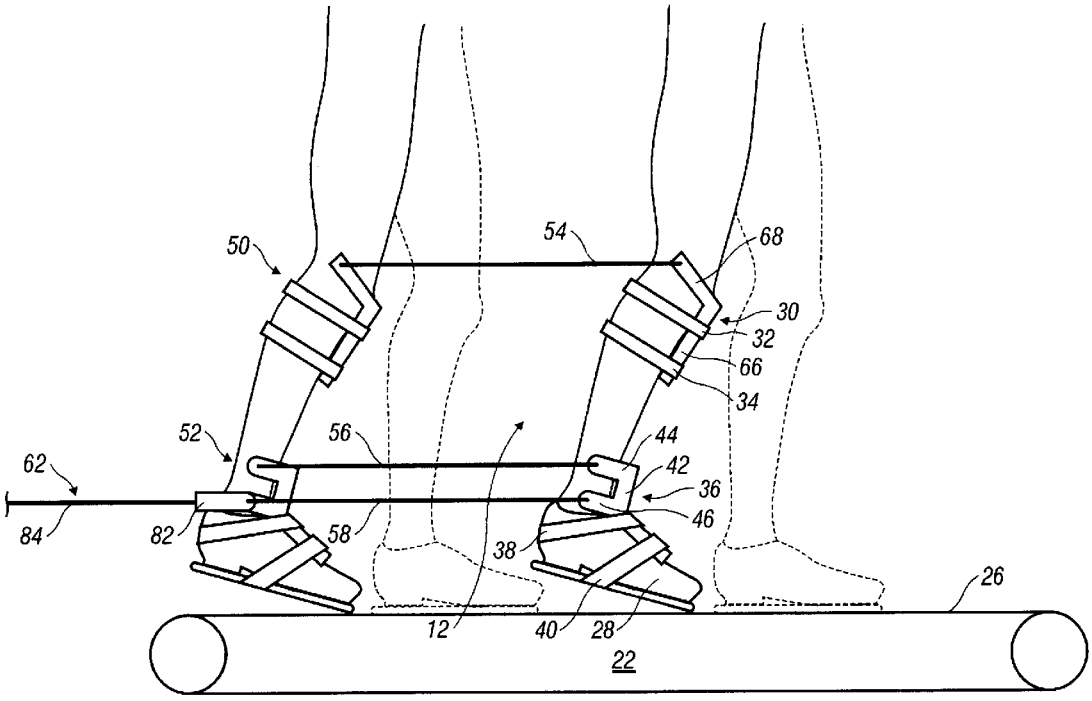
FIG. 5 shows a side elevation of an interconnection between leg appliances and ankle appliances according to the present invention with the feet of a patient and an attendant raised over the surface of a treadmill belt.

Coordination of ankle movement between a patient 14 and attendant 16 requires the formation of links between an ankle appliance 36 and an ankle brace 52, each of which have similar features as shown in FIGS. 3*a* and 3*b*. In the preferred embodiment illustrated In FIGS. 3*a* and 3*b*, the connection is of the parallel-linkage type. Each ankle appliance 36 includes a foot stem 48 that is angled to fit over the top of a wearer's foot. The foot stem 48 is attached thereto by means of an ankle strap 38 and an instep strap 40, as exemplified in FIG. 1. A bracket 42 extending in front of the ankle has an upper extension 44 and a lower extension 46 in sliding engagement with the bracket 42. In a preferred structure, the upper 44 and lower 46 extensions include an upper slot 74 and a lower slot 76, with the bracket 42 having an upper orifice 78 and a lower orifice 80. A suitable fastener, such as a threaded bolt and wing nut, may be used to hold the extensions 44, 46 to the bracket 42 with bolts inserted through the orifices 78, 80 and slots 74, 76. The slots 74, 76 allow rotational adjustment of the upper 44 and lower 46 extensions for comfortable positioning of the extensions 44,46 around a wearer s ankle. After adjustment, the upper 44 and lower 46 extensions may be secured in position by tightening, such as a wing nut, or activating a similar locking mechanism that maintains the extensions 44, 46 in the desired position during exercise A parallel linkage may be used between either or both of the leg and ankle apparatus. However, such a linkage is particularly suited for the ankle connection. This is because it is important that the patient's foot experiences more exactly the actions and movements of the attendant's foot during the therapy session. This exemplary arrangement between the ankle and/or foot linkages are shown in FIGS. 1, 4 and 5. From these illustrations, it may also be appreciated that the link from patient-leg to therapist-leg and the link from patient-ankle to therapist-ankle also forms a parallel linkage of sorts between the right legs of the therapist 16 and patient 14 and the left legs of the therapist 16 and patient 14.

Though not always appreciated, a person's foot must follow certain tilting movements for natural execution of the walking process. It is important that the patient's foot mimics the natural action that is imparted from the attendant's foot. Therefore, a parallel connection or linkage is aptly suited since it will not only lift and move the patient's foot forward, but the natural tilts and heal strikes of the foot will also be conveyed and experienced, thereby producing a more natural experience for the patient 14, and better train the patient 14 for unaided walking, should rehabilitation to that extent possible Assembly of the linked ankle appliance 36 and the ankle brace 52 may include attachment of an offset link 62 to either the lower extension 46 or upper extension 44 of the ankle brace 52. In a preferred embodiment, the offset link 62 comprises an arcuate clip 82 adapted for attachment to the lower extension 46 of the ankle brace 52. For use on the right side, an elongate stem 84 is connected to the right side of the arcuate clip 82, and for the left side, an elongate stem 84 is connected to the left side of the arcuate clip 82. The elongate stem 84 extends opposite the back of an attendant's heel for positioning on a trailing link support 64. The sliding engagement between the stem 84 and the support 64 assists the attendant 16 in transferring side-to-side foot motions to the patient 14 without imparting a twisting or stress to the attendant's ankles and/or knee joints. Each of the arcuate clips 82, upper extension 44, and lower extension 46 include suitable points of pivotal interconnection for attachment of opposite terminal portions of an upper ankle link 56 and a lower ankle link 58 on either side of the patient's ankle and the attendant's ankle to allow coordinated movement between the ankles of the attendant 16 and the patient 14. Joining mechanisms, previously described for joining leg appliances 30 to leg braces 50, such as ball and socket joints and other well-known types of rotatable bearings or linkages, may be used for linking ankle appliances 36 to ankle braces 52.

FIG. 4 shows interconnection of a rehabilitation apparatus 12 according to the present invention assembled as previously described. The leg appliance 30, strapped to the patient's leg by upper strap 32 and lower strap 34, further includes a shin stem 66 and a leg bracket 68. An attendant's leg brace 50 also includes straps for holding the shin stem and leg bracket just below an attendant's knee. A connecting rod 54, adjustable in length, is pivotally attached at coupling points 60 and directly translates movement of the leg brace 50 into similar movement of the leg appliance 30 allowing a patient to perform the same leg movement as the attendant.

As described above, coupling of the leg appliance 30 to the leg brace 50 preferably includes two connecting rods 54 with attachment of one rod to each end of each U-shaped leg bracket. The rehabilitation apparatus 12 also provides connection between the feet of an attendant and a patient using an ankle brace 52 linked to an ankle appliance 36 by an upper ankle link 56 and a lower ankle link 58. Either or both of the links 56 and 58 may be adjustable in length such that relative orientation of the attendant's and patient's feet may be set.

Referring to the ankle appliance 36, which may have parts in common with the ankle brace 52, a pair of straps 38, 40 holds a foot stem 48 on top of the wearer's foot for deploying a bracket 42 that includes an upper extension 44 and a lower extension 46. A bracket 42 needed here for facilitating the raising and lowering of the toes and heels of the attendant 16 and patient 14 during performance of the walking motion. The patient may be standing either behind or, preferably, in front of the attendant 16. In either position, during the raising of an attendant's toes the belt 26 of a treadmill 22, the upper link 56 moves rearward relative to the lower link 58. Since the patient 14 is suspended in a partial weight-bearing condition with little or no control over the paralyzed leg(s), the movement of the links 56, 58 causes the patient's toes to lift in response to the corresponding movement by the attendant 16. When the heel of the attendant 16 is raised, pivotal movement of the links 56, 58 in reverse to that just described causes the heel of the patient 14 to be similarly raised. As earlier described, the rehabilitation apparatus further includes an offset link 62 for controlling side-to-side foot motions as previously described.

FIG. 4 shows the leg positions of an attendant 16 standing behind a patient when the belt 26 of the treadmill 22 is stationary. The legs of both exercise participants are side-by-side so only one is visible in this side elevation. FIG. 5 illustrates the use of a rehabilitation apparatus according to the present invention on a moving treadmill 22 in a situation involving a patient 14 having only one leg paralyzed. The healthy, non-coupled legs of the patient 14 and attendant 16 are shown by a discontinuous-line in the background. The leg requiring assistance is shown In the foreground with a rehabilitation apparatus attached between the attendant 16 and patient 14. Once the trailing leg has reached a suitable rearward position, the heel of the attendant begins to raise from the surface of the belt 26 of the treadmill 22. This moves the upper and lower links 56, 58, displacing the patient's heel from the belt 26 prior to the attendant's being raised and lifting the foot above the treadmill 22 before swinging the leg forward to begin the next stride. Transmission of each movement through the rehabilitation apparatus 12 causes the patient to perform a corresponding movement with his or her paralyzed leg.

In most cases, it is anticipated that leg paralysis will be only partial thereby allowing the patient 14 to exert at least some effort towards sustained walking exercise. Regardless of a patient's initial condition, one purpose of the new rehabilitation apparatus constructed according to the present invention is to refamiliarize the patient with the sensations of walking motion and to also provide therapy to strengthen the affected leg muscles, all working towards the ultimate goal of enabling the patient to walk unattended, if possible.

A rehabilitation apparatus and its components have been described herein. These and other variations, which will be appreciated by those skilled in the art, are within the intended scope of this invention as claimed below. As previously stated, detailed embodiments of the present invention are disclosed herein; however, it is to be understood that the disclosed embodiments are merely exemplary of the invention that may be embodied in various forms.

What is claimed is:

1. An apparatus adapted to be coupled between an attendant positioned adjacent to a patient on a treadmill for rehabilitation of a leg suffering from paralysis, said apparatus comprising:

a leg appliance secured to the patient's leg, said leg appliance including a leg bracket;

a leg brace secured to the attendant's leg, said leg brace including a bracket;

at least one connecting member adapted for coupling said leg bracket to said bracket of said leg brace for transmitting motion from the attendant's leg to the patient's leg using forces acting from said leg brace to said leg appliance through said connecting member;

an ankle appliance attached to the patient's foot, said ankle appliance having an upper extension and a lower extension proximate the ankle of the patient; and an ankle brace attached to the attendant's foot, said ankle brace having a brace upper extension arid a brace lower extension adjacent the attendant's ankle, said brace upper extension coupled by an upper ankle link to said upper extension of said ankle appliance, and said brace lower extension coupled by a lower ankle link to said lower extension of said ankle appliance, said upper link and said lower link adapted to create movement of the patient's foot corresponding to movement of the attendant's foot during walking whereby coordinated leg and ankle movement causes the patient's leg to duplicate the walking motion of the attendant's leg.

2. An arrangement adapted to be coupled between a therapist positioned in front of or behind a patient on an exercise assembly for rehabilitation of at least one leg suffering from an impaired ability, said arrangement comprising:

a parallel linkage means for establishing a connection between a therapist and a patient, said parallel linkage means having an upper link means for spanning between the therapist's leg and patient's leg and a lower link means for spanning between the therapist's foot and patient's foot whereby patient motion is caused to therapeutically mimic therapist motion.

3. The arrangement as recited in claim 2 wherein said lower link means comprises a parallel linkage means for spanning between the therapist's foot and patient's foot.

4. The arrangement as recited in claim 2, further comprising:

two parallel linkage means for establishing a connection between the right and left legs of the therapist and patient, each of said parallel linkage means having an upper link means for spanning between the therapist's leg and patient's leg and a lower link means for spanning between the therapist's foot and patient's foot.

5. The arrangement as recited in claim 2, further comprising:

an offset link means connected to said lower link means and slidable in a fixed support whereby side-to-side foot motion is made transferable from the therapist to the patient.

6. The arrangement as recited in claim 2, further comprising:

a patient lifting means for counter-balancing a portion of a patient's weight during therapeutic activity on an exercise assembly.

7. The arrangement as recited in claim 6 further comprising a treadmill as an exercise assembly.

8. An arrangement adapted to be coupled between a therapist positioned in front of or behind a patient on an exercise assembly for rehabilitation of a leg of the patient suffering from impaired utility such as paralysis, said arrangement comprising:

a linkage means for connecting a therapist and a patient by spanning therebetween and whereby leg motion by the therapist is imputed to the patient whereby patient motion is caused to therapeutically mimic therapist motion.

9. The arrangement as recited in claim 8, further comprising said linkage means being adapted for communicating rotational and tilting motion between the therapist's foot and the patient's foot.

10. The arrangement as recited in claim 8, further comprising:

a patient lifting means for counter-balancing a portion of the patient's weight during therapeutic activity on an exercise assembly.

11. An arrangement coupled between a therapist positioned in front of or behind a patient on an exercise assembly for rehabilitation of at least one leg suffering from an impaired ability, said arrangement comprising:

a parallel linkage connected between a therapist and a patient, said parallel linkage having an upper rigid link spanning between the therapist's leg and patient's leg and a lower rigid link spanning between the therapist's foot and patient's foot whereby patient motion is caused to therapeutically mimic therapist motion.

12. The arrangement as recited in claim 11 wherein said lower link further comprises a parallel linkage spanning between the therapist's foot and patient's foot.

13. The arrangement as recited in claim 11, further comprising:

two parallel linkages connected between respective right and left legs of the therapist and patient, each of said parallel linkages having an upper link spanning between the therapist's leg and patient's leg and a lower link spanning between the therapist's foot and patient's foot.

14. The arrangement as recited in claim 11, further comprising:

an offset link connected to said lower link and slidable in a fixed support whereby side-to-side foot motion is transferred from the therapist to the patient.

15. The arrangement as recited in claim 11, further comprising:

a patient lifting means for counter-balancing a portion of a patient's weight during therapeutic activity on an exercise assembly.

16. The arrangement as recited in claim 11 further comprising a treadmill as an exercise assembly.

17. An arrangement adapted to be coupled between a therapist positioned in front of or behind a patient on an exercise assembly for rehabilitation of a leg of the patient suffering from impaired utility such as paralysis, said arrangement comprising:

a linkage connected between a therapist and a patient including means for communicating rotational and tilting motion between the therapist's foot and the patient's foot whereby patient motion is caused to therapeutically mimic therapist motion.

18. The arrangement as recited in claim 17, further comprising:

a patient lifting means for counter-balancing a portion of the patient's weight during therapeutic activity on an exercise assembly.

* * * * *